US009131767B2

(12) United States Patent
Hohlbein et al.

(10) Patent No.: US 9,131,767 B2
(45) **Date of Patent: *Sep. 15, 2015**

(54) ORAL CARE IMPLEMENT

(71) Applicant: COLGATE-PALMOLIVE COMPANY, New York, NY (US)

(72) Inventors: Douglas Hohlbein, Hopewell, NJ (US); Alan Sorrentino, Cranbury, NJ (US); James Herbert Kemp, Basking Ridge, NJ (US); Emily Fink, New York, NY (US)

(73) Assignee: COLGATE-PALMOLIVE COMPANY, New York, NY (US)

( * ) Notice: Subject to any disclaimer, the term of this patent is extended or adjusted under 35 U.S.C. 154(b) by 1 day.

This patent is subject to a terminal disclaimer.

(21) Appl. No.: 13/899,517

(22) Filed: May 21, 2013

(65) Prior Publication Data

US 2013/0263397 A1 Oct. 10, 2013

Related U.S. Application Data

(63) Continuation of application No. 12/145,999, filed on Jun. 25, 2008, now Pat. No. 8,459,892.

(51) Int. Cl.

| | |
|---|---|
| ***A46B 11/00*** | (2006.01) |
| ***A46B 9/04*** | (2006.01) |
| ***A46B 15/00*** | (2006.01) |

(52) U.S. Cl.

CPC ..... *A46B 11/0003* (2013.01); *A46B 9/04* (2013.01); *A46B 11/0006* (2013.01); *A46B 15/0055* (2013.01); *A46B 15/0081* (2013.01); *A46B 2200/1066* (2013.01)

(58) Field of Classification Search

USPC ..... 401/16, 17, 132

See application file for complete search history.

(56) References Cited

U.S. PATENT DOCUMENTS

| | | | |
|---|---|---|---|
| 792,471 | A | 6/1905 | Smith |
| 846,900 | A | 3/1907 | Bloom |

(Continued)

FOREIGN PATENT DOCUMENTS

| | | |
|---|---|---|
| CA | 2236416 | 5/1997 |
| CA | 2728653 | 12/2009 |

(Continued)

OTHER PUBLICATIONS

International Search Report and Written Opinion for International Application No. PCT/US2009/030090 mailed Apr. 3, 2009.

*Primary Examiner* — David Walczak
*Assistant Examiner* — Bradley Oliver

(57) ABSTRACT

An oral care implement (210) includes a handle (214) and a head (212) mounted to one end of the handle (214) that includes a first face (237) having plurality of tooth cleaning elements (226) extending therefrom, a second face (247) and a store of oral care material (232). A soft tissue cleaner (241) can be included on the second face (247). Oral care material can be provided simultaneously to the first (237) and second faces (247) during use from the store of oral care material (232). The oral care implement can include a plurality of oral care material stores (232), which can include different dentifrices. A store of oral care material (232) can be located within an arrangement of the tooth cleaning elements (226) and can extend through the head (212) to an arrangement of soft tissue cleaning elements (226). The toothbrush (210) can be small in size and lightweight so as to be readily portable for use away from the home.

20 Claims, 11 Drawing Sheets

(56) References Cited

U.S. PATENT DOCUMENTS

| | | | |
|---|---|---|---|
| 876,185 | A | 1/1908 | Hillman |
| 1,214,556 | A | 2/1917 | Le Vene et al. |
| 1,256,662 | A | 2/1918 | Clemah et al. |
| 1,411,681 | A | 4/1922 | Burlew |
| 1,500,722 | A | 7/1924 | Roush |
| 1,575,317 | A | 3/1926 | Carmichael |
| 1,602,531 | A | 10/1926 | Itoh |
| 1,784,986 | A | 12/1930 | Eisenberg |
| 1,796,367 | A | 3/1931 | Grove |
| 1,797,946 | A | 3/1931 | Eichel |
| 1,811,833 | A | 6/1931 | Simon |
| RE19,006 | E | 11/1933 | Graves |
| 1,944,067 | A | 1/1934 | Collins |
| 1,950,767 | A | 3/1934 | Abbott |
| 1,968,303 | A | 7/1934 | McMath |
| D94,303 | S | 1/1935 | Hadley |
| 1,995,374 | A | 3/1935 | Young |
| 2,077,758 | A | 4/1937 | Johnson et al. |
| D112,719 | S | 12/1938 | Miller |
| 2,233,831 | A | 3/1941 | Burke |
| 2,241,584 | A | 5/1941 | Cohen |
| 2,259,928 | A | 10/1941 | Eaton |
| 2,262,982 | A | 11/1941 | Wolcott |
| 2,307,493 | A | 1/1943 | Davidson |
| 2,386,085 | A | 10/1945 | Babel |
| D161,873 | S | 2/1951 | Rosengard |
| 2,649,959 | A | 8/1953 | Hallahan |
| 2,710,982 | A | 6/1955 | Gillem |
| 2,736,917 | A | 3/1956 | Goldstein et al. |
| 2,739,328 | A | 3/1956 | Bernier |
| 2,778,045 | A | 1/1957 | Bly et al. |
| 2,793,381 | A | 5/1957 | McWhorter |
| 2,813,290 | A | 11/1957 | Aschenbach |
| 3,068,571 | A | 12/1962 | Thompson |
| 3,078,856 | A | 2/1963 | Bender et al. |
| 3,103,935 | A | 9/1963 | Woodrow |
| 3,148,684 | A | 9/1964 | Keeler |
| 3,165,776 | A | 1/1965 | Tuseth |
| 3,301,267 | A | 1/1967 | Gerardi et al. |
| 3,316,580 | A | 5/1967 | Tebbs |
| 3,432,245 | A | 3/1969 | Hudson |
| 3,458,268 | A | 7/1969 | Wozab et al. |
| 3,491,396 | A | 1/1970 | Eannarino et al. |
| 3,501,243 | A | 3/1970 | Heiskell et al. |
| 3,536,140 | A | 10/1970 | Wargoe |
| 3,589,823 | A | 6/1971 | Hendrickson |
| 3,609,789 | A | 10/1971 | Slater |
| 3,698,405 | A | 10/1972 | Walker |
| 3,879,139 | A | 4/1975 | Dahl et al. |
| 3,917,420 | A | 11/1975 | Watson |
| 4,039,261 | A | 8/1977 | Evans |
| 4,194,290 | A | 3/1980 | Vallhonrat |
| 4,292,304 | A | 9/1981 | Barels et al. |
| 4,427,116 | A | 1/1984 | Brown |
| D278,863 | S | 5/1985 | Bradley |
| 4,598,437 | A | 7/1986 | Ernest et al. |
| 4,610,045 | A | 9/1986 | Rauch |
| 4,628,564 | A | 12/1986 | Youssef |
| 4,690,816 | A | 9/1987 | Hata et al. |
| 4,829,621 | A | 5/1989 | Phenegar |
| 4,864,676 | A | 9/1989 | Schaiper |
| 4,911,187 | A | 3/1990 | Castillo |
| 4,961,717 | A | 10/1990 | Hickey |
| 5,052,071 | A | 10/1991 | Halm |
| 5,061,106 | A | 10/1991 | Kent |
| 5,133,971 | A | 7/1992 | Copelan et al. |
| 5,184,719 | A | 2/1993 | Gordon |
| 5,213,428 | A | 5/1993 | Salman |
| 5,366,310 | A | 11/1994 | Armelles Flors |
| 5,390,984 | A | 2/1995 | Boucherie et al. |
| 5,393,796 | A | 2/1995 | Halberstadt et al. |
| 5,398,367 | A | 3/1995 | Lu |
| 5,476,333 | A | 12/1995 | Matthews |
| 5,490,530 | A | 2/1996 | Snowden |
| 5,522,109 | A | 6/1996 | Chan |
| 5,533,791 | A | 7/1996 | Boucherie |
| D378,166 | S | 2/1997 | Savitt et al. |
| 5,609,890 | A | 3/1997 | Boucherie |
| D378,711 | S | 4/1997 | Occhetti |
| 5,633,083 | A | 5/1997 | Iwai et al. |
| 5,860,183 | A | 1/1999 | Kam |
| 5,888,002 | A | 3/1999 | Fenstersheib |
| 5,915,868 | A | 6/1999 | Frazell |
| 6,004,059 | A | 12/1999 | Zaccaria |
| 6,018,840 | A | 2/2000 | Guay et al. |
| 6,090,488 | A | 7/2000 | Kweon |
| 6,119,296 | A | 9/2000 | Noe et al. |
| 6,135,274 | A | 10/2000 | James |
| D435,347 | S | 12/2000 | Rumsey, Jr. |
| 6,158,444 | A | 12/2000 | Weihrauch |
| 6,179,503 | B1 | 1/2001 | Taghavi-Khanghah |
| 6,321,407 | B1 | 11/2001 | Weihrauch |
| 6,397,860 | B1 | 6/2002 | Hill, II |
| 6,401,291 | B1 | 6/2002 | Lee |
| 6,463,618 | B1 | 10/2002 | Zimmer |
| 6,524,023 | B2 | 2/2003 | Andersen |
| 6,526,993 | B1 | 3/2003 | Wagner |
| 6,602,013 | B2 | 8/2003 | Clark |
| D487,351 | S | 3/2004 | Frazell |
| 7,039,984 | B1 | 5/2006 | Watanabe et al. |
| D527,528 | S | 9/2006 | Hohlbein |
| D528,803 | S | 9/2006 | Hohlbein |
| D532,202 | S | 11/2006 | Hohlbein |
| D532,607 | S | 11/2006 | Hohlbein |
| 7,182,542 | B2 | 2/2007 | Hohlbein |
| 7,273,327 | B2 | 9/2007 | Hohlbein et al. |
| 7,331,731 | B2 | 2/2008 | Hohlbein et al. |
| 7,478,959 | B2 | 1/2009 | Hohlbein |
| 7,931,418 | B1 | 4/2011 | Atkin |
| 8,109,686 | B2 | 2/2012 | Bartschi et al. |
| 8,240,937 | B2 | 8/2012 | Sorrentino et al. |
| 8,282,298 | B2 | 10/2012 | Robinson et al. |
| 2002/0084550 | A1 | 7/2002 | Roberts et al. |
| 2002/0106234 | A1 | 8/2002 | Johnson |
| 2002/0152538 | A1 | 10/2002 | McDevitt et al. |
| 2002/0175101 | A1 | 11/2002 | Albert |
| 2003/0100908 | A1 | 5/2003 | Grumberg et al. |
| 2003/0188761 | A1 | 10/2003 | Garcia et al. |
| 2005/0069372 | A1 | 3/2005 | Hohlbein et al. |
| 2005/0147458 | A1 | 7/2005 | Hohlbein |
| 2006/0165473 | A1 | 7/2006 | Hohlbein |
| 2008/0004648 | A1 | 1/2008 | Hohlbein et al. |
| 2008/0014010 | A1 | 1/2008 | Bartschi et al. |
| 2008/0104786 | A1 | 5/2008 | Hohlbein et al. |
| 2008/0120798 | A1 | 5/2008 | Sorrentino et al. |
| 2008/0201884 | A1 | 8/2008 | Vazquez et al. |
| 2009/0044356 | A1 | 2/2009 | Noble et al. |
| 2009/0178219 | A1 | 7/2009 | Hohlbein et al. |
| 2012/0121312 | A1 | 5/2012 | Bartschi et al. |

FOREIGN PATENT DOCUMENTS

| | | |
|---|---|---|
| CH | 664271 | 2/1988 |
| CN | 2111027 | 7/1992 |
| CN | 2420901 | 2/2001 |
| CN | 2469777 | 1/2002 |
| CN | 1694636 | 11/2005 |
| DE | 594479 | 3/1934 |
| DE | 850981 | 9/1952 |
| DE | 3529953 | 3/1987 |
| DE | 3638696 | 5/1988 |
| DE | 4127429 | 2/1993 |
| DE | 4231817 | 3/1994 |
| DE | 4238421 | 5/1994 |
| DE | 19531368 | 2/1997 |
| DE | 19842984 | 8/2000 |
| DE | 19925568 | 12/2000 |
| EP | 0332026 | 9/1989 |
| EP | 0475314 | 3/1992 |
| EP | 0481926 | 4/1992 |
| EP | 0872195 | 10/1998 |
| EP | 1415572 | 5/2004 |
| EP | 1639913 | 11/2011 |
| ES | 2090287 | 10/1996 |

(56) References Cited

FOREIGN PATENT DOCUMENTS

| | | | |
|---|---|---|---|
| FR | 2550429 | | 2/1985 |
| FR | 2554331 | | 5/1985 |
| FR | 2602129 | | 2/1988 |
| FR | 2646068 | | 10/1990 |
| FR | 2654598 | | 5/1991 |
| FR | 2754436 | | 4/1998 |
| FR | 2772569 | | 6/1999 |
| FR | 2772571 | | 6/1999 |
| FR | 2822658 | | 10/2002 |
| GB | 228460 | | 2/1925 |
| GB | 746649 | | 3/1956 |
| GB | 2297489 | | 8/1996 |
| GB | 2351015 | | 12/2000 |
| GB | 2388529 | | 11/2003 |
| GB | 2394653 | | 5/2004 |
| JP | 3-043427 | U | 9/1997 |
| JP | 10-216158 | A | 8/1998 |
| JP | 10-262732 | A | 10/1998 |
| JP | 2002-142865 | A | 5/2002 |
| JP | 2003-245133 | A | 9/2003 |
| SU | 1291019 | | 2/1987 |
| SU | 1417859 | | 8/1988 |
| TW | 316404 | | 9/1997 |
| WO | WO 87/00425 | | 1/1987 |
| WO | WO 97/16995 | | 5/1997 |
| WO | WO 98/57570 | | 12/1998 |
| WO | WO 99/23910 | | 5/1999 |
| WO | WO 99/60886 | | 12/1999 |
| WO | WO 01/26504 | | 4/2001 |
| WO | WO 02/15736 | | 2/2002 |
| WO | WO 02/26079 | | 4/2002 |
| WO | WO 02/34083 | | 5/2002 |
| WO | WO 02/058508 | | 8/2002 |
| WO | WO 03/037210 | | 5/2003 |
| WO | WO 2004/010821 | | 2/2004 |
| WO | WO 2004/021914 | | 3/2004 |
| WO | WO 2005/110149 | | 11/2005 |
| WO | WO 2006/055369 | | 5/2006 |
| WO | WO 2007/149919 | | 12/2007 |
| WO | WO 2008/091933 | | 7/2008 |
| WO | WO 2008/103597 | | 8/2008 |

ORAL CARE IMPLEMENT

CROSS-REFERENCE TO RELATED APPLICATIONS

The present application is a continuation of U.S. patent application Ser. No. 12/145,999, filed Jun. 25, 2008, the entirety of which is incorporated by reference herein.

BACKGROUND

The present application relates generally to oral care implements, such as toothbrushes, soft tissue cleaners and combined tooth cleaning/soft tissue cleaning devices, and, more particularly, to an oral care implement having an enhanced oral care dispenser mechanism, such as a store of releasable dentifrice and an enhanced mechanism for dispensing the dentifrice during use.

The advantages of good dental hygiene are well known. Often, however, toothbrushes are forgotten when one is traveling or away from home. Hotels, health care facilities, nursing homes, hospitals, daycare facilities, schools, airlines, etc. have a need for single use disposable or limited multiple use toothbrushes that can be economically supplied to and discarded by individuals without a toothbrush and/or a water supply. Such toothbrushes could be used in vending machines, or distributed in large quantities for simple, portable use from anywhere.

Various types of disposable, limited use, or portable toothbrushes are known in the art. For example, some toothbrush systems have attempted to meet some of these needs by providinv, toothpaste within the toothbrush itself, through an integrated channel, for distribution through the toothbrush and around the bristles. This approach can be less economical due to the added manufacturing costs of toothbrushes with integrated channels. In addition, the toothpaste in some of these integrated channel toothbrushes, not being properly sealed, has as tendency to become dry, hard and stale. Further, these types of toothbrushes attempt to provide basic teeth cleaning without effectively engaging soft oral tissues or providing effective tongue cleaning.

BRIEF SUMMARY OF THE INVENTION

The various features described herein can help improve dental care by providing enhanced dispensing of a oral care material along with superior cleaning of teeth and/or soft oral tissues.

An oral care implement described herein can include a handle and a head mounted to one end of the handle that includes a first face having a plurality of tooth cleaning elements extending, therefrom, a second face, and a store of oral care material such as dentifrice. Oral care material can be provided to the first and second faces during use from the store of oral care material. The second face can include a plurality of soft tissue cleaning elements extending therefrom.

The oral care implement can include a plurality of stores of oral care material, which can be different oral care materials. Further, a store of oral care material can be located within an arrangement of the tooth cleaning elements to provide oral care material thereto, and can be accessible through the head to an arrangement of the soft tissue cleaning elements to further provide dentifrice thereto. The store or stores of oral care material can include a rupturable or dissolvable store of oral care material, which can simultaneously dispense oral care material to the teeth and to soft tissues, such as the inside of cheeks or the surface of the tongue, to provide cleaning and other benefits, such as breath freshening.

Other features and configurations are described in the sections that follow.

BRIEF DESCRIPTION OF THE DRAWINGS

The features herein will become more fully understood from the detailed description given herein below, and the accompanying drawings, which are given by way of non-limiting illustration only.

DETAILED DESCRIPTION OF THE INVENTION

Figure 1:
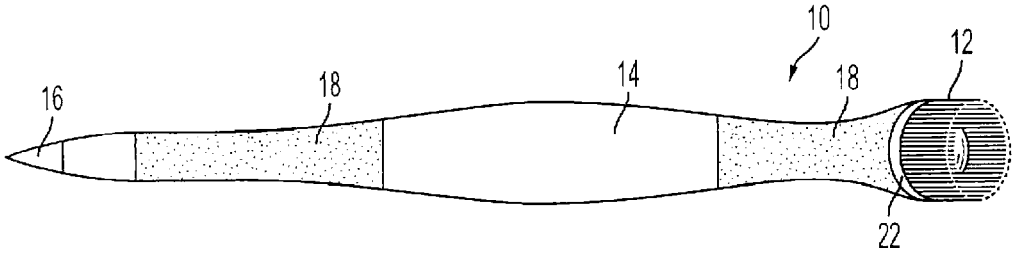
FIG. 1 is a front view of an oral care toothbrush with a toothpick and a capsule connected thereto.

The following detailed description refers to the accompanying drawings. The same reference numbers in different figures identify the same or similar elements.

FIGS. 1-4 illustrate an oral care toothbrush 10 that includes a head 12 and a handle 14. Head 12 can be a refill head and thus can be removably connected to handle 14, or head 12 can be permanently connected to handle 14.

The majority of handle 14 and a portion of head 12 can be molded from a variety of rigid materials, including plastics, resins, etc., such as, for example, polypropylene. An end portion of handle 14, is attached to an accessory, preferably a toothpick 16 formed of a resilient and soft thermoplastic elastomer. Toothpick 16 can be a refill and thus be removably connected to handle 14, or toothpick 16 can be permanently connected to handle 14. Toothpick 16 provides a mechanism for spot cleaning between teeth. Forming toothpick 16 of a soft elastomer provides more comfortable interproximal cleaning between teeth. Toothpick 16 could, however, be made of a stiff rigid material similar to the main portion of handle 14, or could simply be a rubber or elastomeric pick adhered or otherwise mounted to the end of handle 14.

Portions 18 of handle 14 can also be formed of a resilient and soft thermoplastic elastomer. The thermoplastic elastomer which forms toothpick 16 and handle portions 18 can be a thermoplastic vulcanate (TPV) consisting of a mixture of polypropylene and EPDM (ethylene propylene diene monomers) which is available as SANTOPRENE (brand), described in U.S. Pat. No. 5,393,796, or VYRAM (brand), another TPV consisting of a mixture of polypropylene and natural rubber. Both SANTOPRENE and VYRAM (brands) are elastomers marketed by Advanced Elastomer Systems. Other suitable elastomers include KRATON, a brand of styrene block copolymer (SBC) marketed by Shell, and DYNAFLEX G 2706 (brand), a thermoplastic elastomer marketed by GLS Corporation and which is made with KRATON (brand) polymer.

Handle 14 can further include dimples, bumps, or ridges protruding from portions of its surface, and providing a decorative appearance to handle 14 and enhanced gripping of handle 14 during use of toothbrush 10. The dimples can be formed from the same material as soft elastomer portions 18 of handle 14 or from the same material as the majority of handle 14 (e.g., a rigid material such as polypropylene). All or part of handle 14 could be made of any suitable material, such as plastic, wood, metal or various natural materials which are biodegradable. Preferably handle 14 is made of a generally flat or oval shape rather than cylindrical in its gripping portion which would be between the spaced elastomer portions 18 to facilitate the gripping of the handle.

Figure 4:
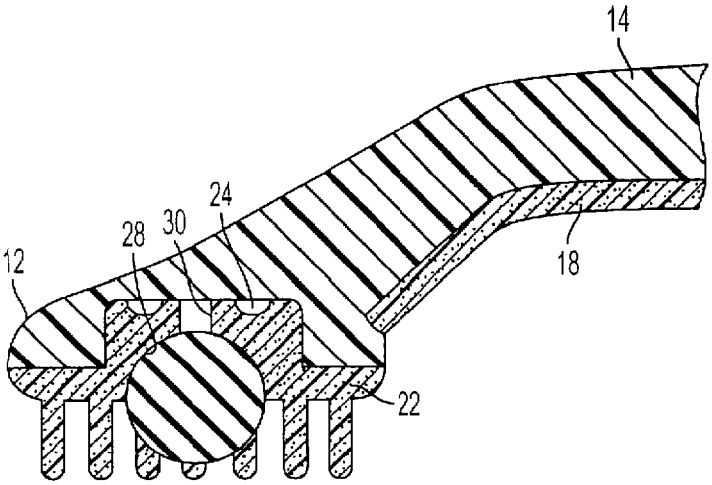
FIG. 4 is a fragmental, cross-sectional view of the head of the toothbrush of FIGS. 1-3.

As shown in FIG. 4 another portion of head 12, defining a bristle or cleaning element block 22 of head 12, can also be formed of a resilient and soft thermoplastic elastomer, such as the thermoplastic elastomer used to form handle portions 18. Cleaning block 22 can include one or more depressions 28 provided in a surface 24 thereof with an opening 30 therein that provides a cushioning effect to a rupturable dispenser, preferably a gel capsule 32, contained therein, as described more fully below. Cleaning element block 22 further includes a multitude of cleaning elements which could be conventional filament, preferably nylon, or elastomeric bristles or fingers 26 extending integrally outwardly from the outer surface of head 12. In the illustrated configuration, all of the cleaning elements 26 extend outwardly from the outer surface of cleaning element block 22 the same distance so as to create a generally flat surface. Alternatively, however, some elements 26 can be shorter or longer than other elements 26. The variable length of the cleaning elements 26 is illustrated by the tips **26*a* shown in dotted lines in FIG. 5, with only body portions 26*b* of the cleaning elements 26** shown in solid lines for purposes of clarity and to focus on the variable nature of such elements.

The term "cleaning elements" as used herein is intended to be used in a generic, sense as cleaning elements or massage elements arranged in a circular cross-section shape or any type of desired shape, including straight portions or sinusoidal portions. It is to be understood that the specific illustration of the cleaning elements is merely for exemplary purposes. The features herein can, however, be practiced with various combinations of the same or different configurations (such as stapled, in-mold tufting (IMT) bristle technology as disclosed in U.S. Pat. Nos. 5,609,890, 5,390,984, and 5,533,791, the disclosures of which being incorporated by reference herein in their entirety, etc.) and/or with the same or different bristle materials (such as nylon bristles, spiral bristles, rubber bristles, etc.). Similarly, while FIGS. 1-4 illustrate the cleaning, elements 26 to be generally perpendicular to the outer surface of head 12, some or all of the cleaning elements 26 can be positioned at various angles with respect to the outer surface of head 12. It is thereby possible to select the combination of configurations, materials and orientations to achieve specific intended results, such as enhanced cleaning, tooth polishing, breath freshening, tooth whitening and/or massaging of the gums.

As stated above, the cleaning block 22 can include one or more depressions 28 which are designed to receive and retain an oral care dispenser, such as a store of dentifrice in the form of rupturable gel capsule 32 therein. The one or more depressions 28 can be varied in size so as to accommodate not only varying size dispensers/gel capsule 32, but varying quantities of toothpowder, a toothpaste or tooth cleaning gel dentifrice or other oral care material, for delivery to the denature as the elements 26 extending from the block 22 are applied thereto, during use of the present invention such that the oral care material enhances the cleaning of the dentiture by the cleaning elements. While the present invention can be manufactured containing a packed toothpowder, toothpaste or tooth cleaning gel dentifrice and used repeatedly by the user refilling the dispenser with toothpowder, toothpaste or tooth cleaning gel dentifrice, it is preferably used with one or more gel capsules 32 contained therein. Most preferably the present invention is used with a single gel capsule 32, supplied therewith, so as to be most easily transported, used, and subsequently disposed of however, it can also be used repeatedly with replaceable gel capsules 32, and then disposed of.

It is preferred that the depression is in the form of a cushioned socket 28 sized and shaped to receive and retain the gel capsule 32, without premature rupture of the gel capsule 32 prior to use thereof during application of the bristle block 22 to the denature and brushing thereof. Cushioning socket 28, opening 30 and the material making up bristle block 22 provide a cushioning, effect for gel capsule 32 to prevent gel capsule 32 from rupturing prior to use.

Gel capsule 32 holds and applies a oral care solution/material onto bristles 26 of toothbrush head 12. The oral care solution can be a toothpaste, a gel, a mouthwash, or similar dentifrice or oral hygiene product, or a combination of the same contained in the rupturable capsule 32. Preferably gel capsule 32 is a liquid-filled gel capsule having frangible, thin walls that easily rupture or burst when rubbed against the teeth, or dissolve when mixed with the saliva of a user. The materials making up gel capsule 32 and the oral or mouth care solution contained therein preferably are consumable by the user of toothbrush 10, eliminating the need for water, a sink, or a waste receptacle to expectorate the gel capsule 32 or its contents. The oral care solution remains in gel capsule 32 until toothbrush 10 is ready for use. Gel capsule 32 can be fully sealed, helping the oral care solution to remain fresh until use.

The store of oral care material in the form of a capsule or dispenser 32 can include an active agent. Non-limiting examples of active agents which can be used include antibacterial agents, whitening agents, anti-sensitivity agents, anti-inflammatory agents, anti-attachment agents, plaque indicator agents, flavorants, sensates, breath freshening agents, gum health agents and colorants. Examples of these agents include metal ion agents (e.g., stannous ion, agents, copper ion agents, zinc ion agents, silver ion agents) triclosan; triclosan monophosphate, chlorhexidine, alexidine, hexetidine, sanguinarine, benzalkonium chloride, salicylanilide, domiphen bromide, cetylpyridinium chloride, tetradecylpyridinium chloride. N-tetradecyl-4-ethylpyridinium chloride (TDEPC), octenidine, delmopinol, octapinol, nisin essential oils, furanones, bacteriocins, flavans, flavinoids, folic acids, vitamins, minerals, hydrogen peroxide, urea peroxide, sodium percarbonate, PVP-H2O2, polymer-bound perxoxides, potassium nitrates, occluding agents, bioactive glass, arginine salts, arginine bicarbonate, bacalin, polyphenols, ethyl pyruvate, guanidinoethyl disulfide, tartar control agents, anti-stain ingredients, phosphate salts, polyvinyl phosphorite acid. PVM/MA copolymers; enzymes, glucose oxidase, papain, ficin, ethyl lauroyl arginate menthol, carvone, and anethole, various flavoring aldehydes, esters, and alcohols, spearmint oils, peppermint oil, wintergreen oil, sassafras oil, clove oil, sage oil, eucalyptus oil, marjoram oil, cinnamon oil, lemon oil, lime oil, grapefruit oil, and/or orange oil.

The active agent can be compatible with toothpaste, or can be unstable and/or reactive with typical toothpaste ingredients. The active agent also can be a tooth cleaning agent to boost the overall efficacy of brushing.

The active agent can be provided in any suitable vehicle, such as in aqueous solution or in the form of gel or paste. The vehicle can have a variety of different visual aesthetics including clear solution or gel or opaque solution or gel. Non-limiting examples of vehicles include water, monohydric alcohols such as ethanol, poly(ethylene oxides) such as polyethylene glycols such as PEG 2M, 5M, 7M, 14M, 23M, and 90M available from Union Carbide, carboxymethylene polymers such as Carbopor 934 and 974 available from B.F. Goodrich, and combinations thereof. The selection of a suitable vehicle will be apparent to persons skilled, in the art depending on such factors as the properties of the active agent and the desired properties of the medium, such as viscosity.

In use, gel capsule 32 would be pressed against, the teeth and burst or rupture or dissolve, applying the oral care solution material over cleaning elements 26. The user then can brush his/her teeth with toothbrush 10. The user can also use toothpick 16 to clean between teeth, either before or after brushing. After the user has used toothbrush 10, he/she can, but not necessarily, then easily and economically dispose of toothbrush 10.

In some configurations, the entire structure of toothbrush 10, including head 12, handle 14, and toothpick 16, can be molded as one integral structure, using a conventional two-component injection molding, operation typically used in the manufacture of toothbrushes. This enables toothbrush 10 to be economically and quickly manufactured. Although toothbrush 10 can have a variety of sizes and dimensions, it is preferred that toothbrush 10 have a small profile, with head 12 being small enough to cover one tooth at a time and handle 14 being thinner than conventional, everyday toothbrush handles. Toothbrush 10 is thus readily portable or space saving.

The toothbrush 10 can provide many benefits, including the cosmetic benefits of brushing one's teeth in a form that can be used when one is away from home, and away from a water supply. The cosmetic benefits achieved by the toothbrush 10 include the cleaning of debris between teeth with toothpick 16, broad tooth surface cleaning (particularly the front teeth) with cleaning elements 26 and the mouth care solution of gel capsule 32, and breath freshening with the mouth care solution of gel capsule 32.

In addition to the cosmetic benefits, the toothbrush 10 can also provide economic benefits in the form of an inexpensive toothbrush that is both quickly and economically manufactured. Toothbrush 10 also provides a mechanism for maintaining oral health, without the need for toothpaste, water, mouth wash, and containers to hold the same. Thus, toothbrush 10 is also very convenient to use.

Furthermore, the toothbrush 10 provides at least one benefit of preventing the spread of waterborne diseases. For example, the toothbrush 10 eliminates the conventional practice of using local water to mix with toothpaste. This feature is useful for military applications where there is a limited source of potable water or a need to conserve water or maintain the oral health of troops, such as in desert fighting environments. In another situation, toothbrush is useful in outdoor camping environments to prevent disease or sickness from waterborne bacteria.

Although FIGS. 1-4 illustrate a manually-operated, disposable toothbrush, the features herein can also be practiced. Where the head includes one or more power or electrically operated movable sections carrying cleaning elements. Such movable section can oscillate in a rotational manner or can oscillate linearly in a longitudinal direction with respect to the longitudinal axis of the head or can oscillate linearly in a lateral or transverse direction with respect to the longitudinal axis of the head. The movable section can oscillate in and out in a direction toward and away from the outer surface of the head. The movable section can rock back and forth with respect to the outer surface of the head. The movable section can rotate continuously in the same direction, rather than oscillate. Any suitable drive mechanism can be used for imparting the desired motion to the movable section. Where plural movable sections are used, all of the movable sections can have the same type and direction of movement, or combinations of different movements can be used.

In some configurations, the cleaning elements can be in the form of bristles made from conventional materials, such as nylon, as well as from a combination of materials so as to provide the proper stiffness in an economical manner. For example, the cleaning elements could be made of a flexible resilient material, such as TPE and a lesser expensive material such as LLDPE (linear low density polyethylene) or EVA (ethylene vinyl acetate) or a TPE (e.g., Shore A hardness 5-100). The cleaning elements could be made of a blend of TPE and either LLDPE, EVA, or polypropylene. Preferably, the two materials are combined to provide a stiffness of less than 600 MPa. The blend of materials would give the properties of conventional nylon bristles, while offering reduced costs. For example, there would be lower manufacturing costs by injection molding instead of conventional bristle tufting. Alternatively the resilient material could be a single material, such as hard TPE (i.e. Shore A 80 hardness), straight LLDPE or straight EVA.

The cleaning elements can be of any desired shape. For example, the cleaning elements could be of cylindrical shape having a uniform diameter throughout their length. Alternatively, the cleaning elements could taper from the root of each cleaning element where it extends from head 12 to its outer cleaning end. Since a preferred practice of the invention is to provide a small lightweight toothbrush the dimensions of the various components of toothbrush 10 are preferably small. Thus, for example, each cleaning elements can extend outwardly from the outer surface of cleaning element block 22 a distance no greater than 10 mm and preferably no greater than 8 mm and most preferably no greater than 6 mm. Where tapered cleaning elements are used the root diameter should be no greater than 1.5 mm, preferably no greater than 1 mm, most preferably no greater than 0.7 mm or no greater than 0.5 mm or no greater than 0.3 mm. The diameter could then decrease in size to no greater than 0.2 m at a distance of no greater than 6 mm from the base of the cleaning element. The taper relationship of diameter at a distance location above the root diameter could be a range of no greater than 1 mm at a distance of no greater than 10 mm, preferably no greater than 0.6 mm at a distance of no greater than 8 mm, most preferably no greater than 0.2 mm at a distance of no greater than 6 mm. Preferably, the length of the entire toothbrush 10 is no greater than 5 inches, preferably no greater than 4 inches, and more preferably no greater than 3.75 or 3 or 2.50 inches, and can be in the range of 2 to 4 inches.

Figure 5:
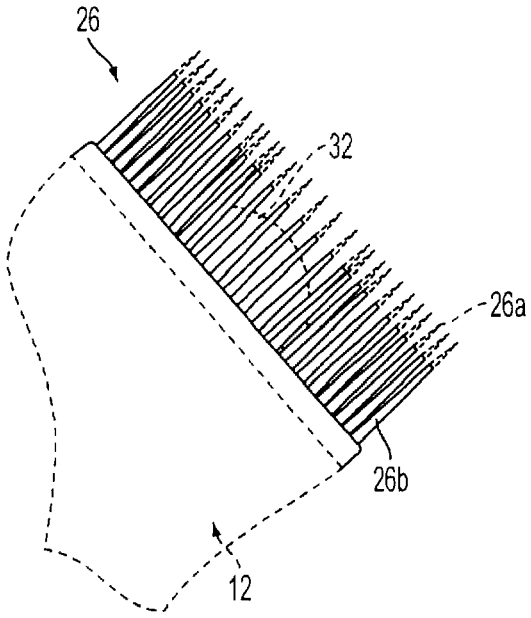
FIG. 5 is a side view of a head of a toothbrush configuration with only portions of the cleaning elements shown in solid lines for purposes of focus and clarity.

As illustrated in FIGS. 1 and 4 the cleaning elements 26 define a cleaning field in the head and the dispenser 32 is mounted within this cleaning field. The cleaning elements 26 preferably extend outwardly from the cleaning block 22 to be approximately flush with the outer surface of the gel bead or capsule 32, as shown in FIG. 4. The features herein, however, can also be practiced where the cleaning elements extend either a greater distance or a lesser distance than the dispenser 32 as shown in FIG. 5. Since toothbrush 10 is intended to be both small and lightweight, it is preferred that toothbrush 10 weigh no more than 3 grams. The small size is such that it can be held completely within the palm of an adult user. Head 12 is of a size that it would correspond to the size of an individual tooth or an individual tooth and the interproximal areas. Head 12 could be made of any suitable shape and is preferably of circular or oval shape having a maximum lateral dimension or diameter of 13 mm or less, preferably less than 12 mm and more preferably less than 11 mm. Where head 12 is of non-circular shape its lateral dimension is preferably 14 mm or less. Non-circular shapes can include square, rectangular, oval, elliptical, rhombial, polygonal, triangular, diamond-shaped, etc.

Figure 2:
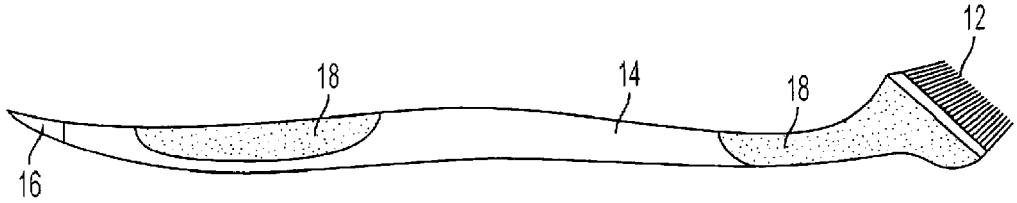
FIG. 2 is a side view of the toothbrush shown in FIG. 1.
Figure 3:
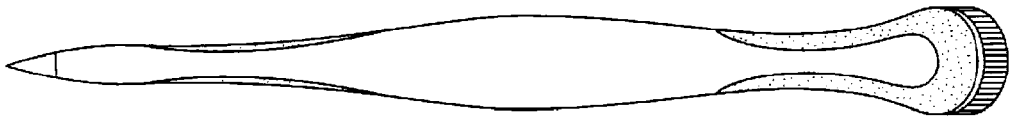
FIG. 3 is a rear view of the toothbrush shown in FIGS. 1-2.

As shown in FIG. 2 head 12 can be at an angle between 0 and 90° to the longitudinal axis of handle 14. The preferred angle is from 20° to 70° and more preferably from 30° to 60°. The cleaning elements 26 could be perpendicular to the outer surface of head 12 or could also be at an angle to the outer surface such as in the range of 60° to 90° or in the range of 75° to 90°.

In one configuration, the cleaning elements 26 could be hollow, such as hollow bristles, which are capable of absorbing a medicament by capillary action. Such a feature would be particularly useful for children where a medicament or some form of flavor could be dispensed from the hollow cleaning elements. It is also possible to leach antibacterial material from the cleaning elements. In one configuration where the cleaning elements are used to dispense oral care materials, the cleaning elements themselves can be considered as the oral care dispensers without requiring additional dispensers such as capsule 32.

Where specific parameters and characteristics have been given for cleaning elements, the features herein could be practiced where other cleaning elements do not include those parameters and characteristics.

Figure 6:
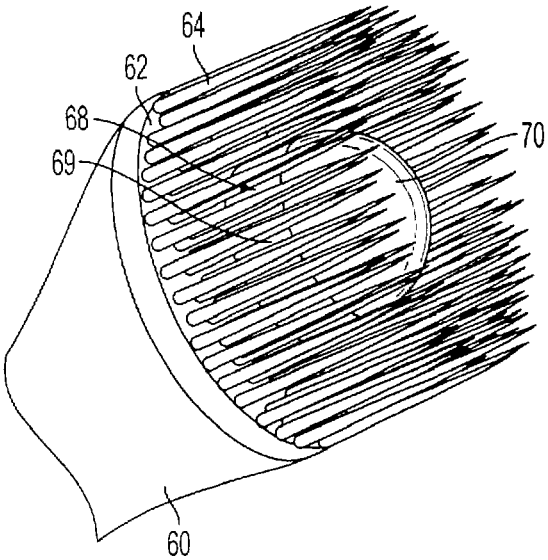
FIG. 6 is a perspective view of one configuration of a toothbrush head.
Figure 7:
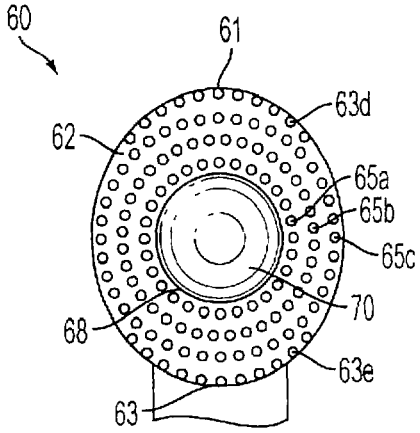
FIG. 7 is an enlarged front view of the head of FIG. 6.

FIGS. 6 and 7 illustrate a head 60 according to another configuration, the head 60 having an outer surface 62, a plurality of cleaning elements 64 extending from a portion of the outer surface 62, and a raised socket 6$ extending from another portion of the outer surface 62. The socket 68 can be formed from the same material as the outer surface 62, and can be integrally formed with the outer surface such as by molding or the like. The socket 68 extends outwardly relative to the outer surface 62 by an upstanding wall 69, and includes a seat to accommodate an oral care dispenser such as a bead or capsule 70 as discussed herein. The raised socket 68 positions the dispenser 70 closer to the edges of the cleaning elements 64 to facilitate contact between the dispenser 70 and the user's teeth and to encourage rupturing of the dispenser 70 early in the brushing process. The socket 68 can also position the dispenser 70 beyond the cleaning elements 64 as discussed above, which would encourage even greater and immediate contact with the user's teeth.

The cleaning elements 64 can comprise a variety of configurations as discussed above, such as a circular configuration as shown in FIG. 1. FIG. 7 illustrates an example of an oval configuration, wherein the cleaning elements 64 are arranged in a plurality of concentric rings 65*a*, 65*b*, 65*c*, surrounding the socket 68. One of such rings is a partial ring comprised of partial ring sections 63*d*, 63*e* defined along the upper and lower edges 61, 63 of the outer surface 62 of the head 60, which sections 63*d*, 63*e* comprise the equivalent of a so-called power tip that is designed to provide a cleaning edge that extends beyond the majority of the field of cleaning elements for increased efficacy.

Any suitable oral care products/materials could be dispensed from the dispenser (i.e. capsule 70). Such products/materials include, but are not limited to the materials described above with reference to the gel capsule 32 and could contain toothpaste, tooth powder or could be a small vial of mouthwash having a gel, a powder or a liquid. Such a vial could be separately included in a package containing the toothbrush. The materials could be flavored and could be provided in sets of different flavors and/or different characteristics such as medicaments, numbing materials, etc.

Where the dispensers 32, 70 are shown as stores of dentifrice in the form of heads, different beads or capsules could be used with different colors/flavors to enhance consumer appeal. As described, the capsule 32, 70 could be an impregnated bead that burst. Suitable beads include those supplied by Mane Inc.

Any suitable methods can be used for forming toothbrush 10 and its various components. For example, multi-component injection molding could be used to integrally couple various components such as the cleaning elements and the head and/or the handle. This could be done in an automated or multiple step process. The handle could be rotocast blow molded to form a hollow squeeze handle that would be usable in the configuration shown in FIG. 11.

As is apparent, the features herein provide an oral care toothbrush that can be small in size and portable and can be conveniently used away from home under circumstances, such as travel, where water is not readily available.

The features herein could be practiced with a combination of various components that do not involve "toothbrush" usage. In that sense these features can be used in any oral care device or the like, rather than strictly being a toothbrush. Where used as a toothbrush or the like, the features herein can have the advantages, because of the size and configuration, to allow discreet hygienic use, such as no fingers in the month, adapting it to be readily used in public areas.

Figure 8:
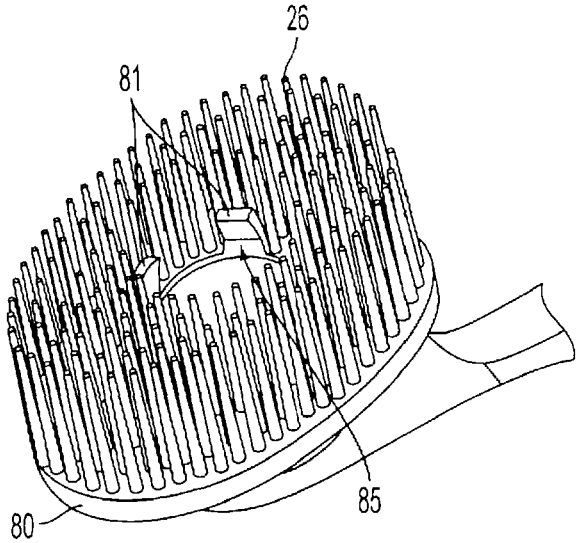
FIG. 8 is a perspective view of an alternate toothbrush head configuration without showing the capsule.

FIG. 8 illustrates another variation in which the head or carrier 80 can have an oval shape, and which can have a series of retaining members 81, such as prongs or biasing members, to hold an oral care dispenser, such as a store of dentifrice in the form of a bead of packed dentifrice or capsule (not shown in the figure), in place prior to use. The retaining members 81 can help retain the bead or capsule at a higher elevation with respect to the field of oral care elements (e.g., bristles 26), to expose more surface area of the bead, dispenser or capsule 32 to the user's saliva to improve the "mouth-feel" and expedite the dissolving of the bead, dispenser or capsule. As illustrated, the retaining members 81 can retain the bead, dispenser or capsule beneath the distal ends of the bristles 26, so as to keep the bead, dispenser or capsule submerged within the field of bristles 26, such that the bristles extend beyond the bead, dispenser or capsule at the bristles' distal ends.

The retaining members 81 can be made of the same material as the bristles 26, or alternatively they can be made of a different material having greater rigidity than the bristles. In one construction, the retaining members 81 can be made of the same material as elastomer portions 18.

Figure 9:
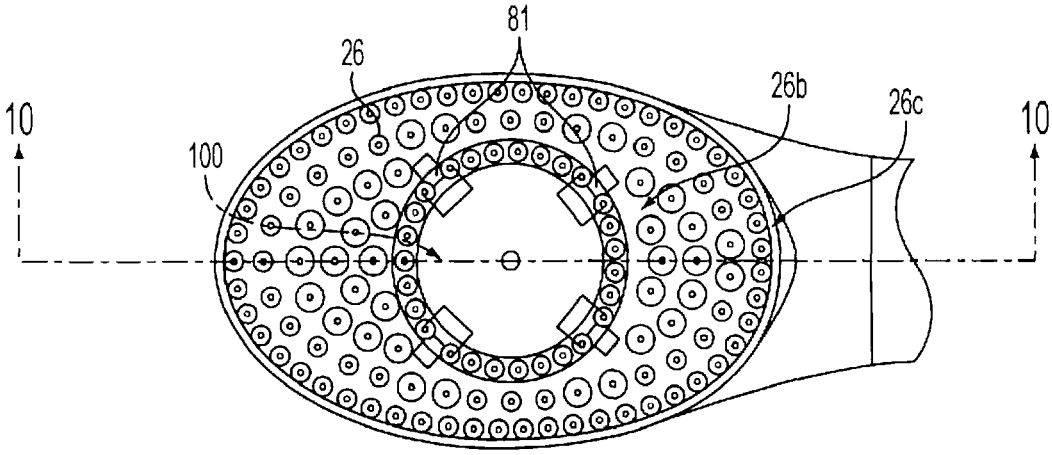
FIG. 9 is an enlarged front view of the head of FIG. 8 without showing the capsule.

The number of retaining members 81 used can vary depending on the type of head or capsule, and the amount of retention force assistance. As illustrated in FIG. 9, four retaining members 81 can be used at four cardinal points around the perimeter of the bead or capsule. Greater or fewer retaining members 81 can be used. For example, some configurations might use three retaining members 81 at triangular points around the perimeter, while other configurations might use five, six, or more retaining members around the perimeter. The retaining members 81 can be positioned such that the bead or capsule is held in a centered position with respect to the bristles 26.

Figure 17:
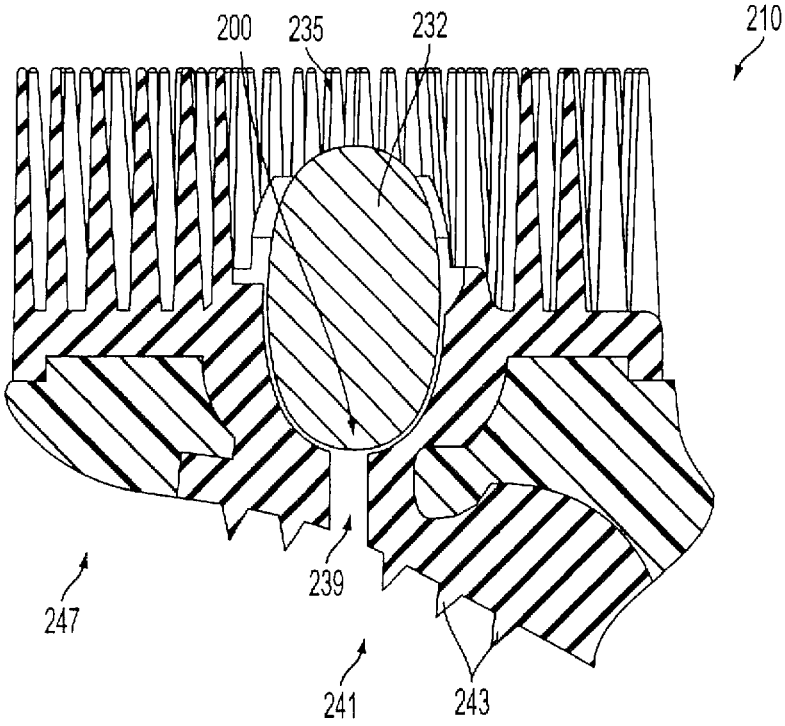
FIG. 17 is an enlarged cross-sectional side view of the head of FIG. 16.

As also shown in FIG. 9, the bristles 26 can vary in diameter at their proximate ends, so that bristles in different areas of the field have different thicknesses and rigidity or axial stiffness as measured from the longitudinal axis of the bristle. In such a construction, inner or central region bristles 26*b* are stiffer than the outer or peripheral region bristles 26*c*. The bristles 26 of the carrier 80 can taper towards their distal ends, as seen in FIG. 17.

With reference to FIG. 9, the variable stiffness arrangement of the field of bristles 26 forms a structure for incremental radial flow control of oral care solution/oral hygiene material during a brushing operation for efficient cleaning. This feature is particularly useful for low viscosity oral care solutions released from the dispenser 32. Nevertheless, oral care solutions of higher viscosity can be used in the carrier 80. The bristles surrounding retaining members 81 are independently flexible. In this regard, during a brushing operation, the free ends (e.g., tip) of the stiffer bristles 26*b* bend relative to their, respective vertical axis less than the outer bristles 26*c* (e.g., bristles near the periphery). Hence, a portion of the dentifrice stays longer in the central region of the brush head by reduced dynamic bending or action of the stiffer bristles. The sweeping or oscillating motion of the carrier 80 transfers a portion of the retained liquid to the outer region of the carrier 80. While the outer bristles 26*c* are less stiff, the dynamic bending relative to their vertical axis additionally causes the outer bristles 26*c* to receive a portion of the dentifrice from the central region of the carrier 80. In this construction, effective cleaning of the tissue surfaces in the mouth can be obtained, though the combined use of the variable stiffness bristle field mechanically scrubbing the tissue surfaces and the beneficial effects of applying the oral care material from the dispenser in the oral cavity. In this way, the bristles field provides a limited and controlled flow of the dentifrice or other oral care material to the outer bristles and maintains sufficient flexibility to provide greater user comfort and improved cleaning of the oral tissues.

Figure 10:
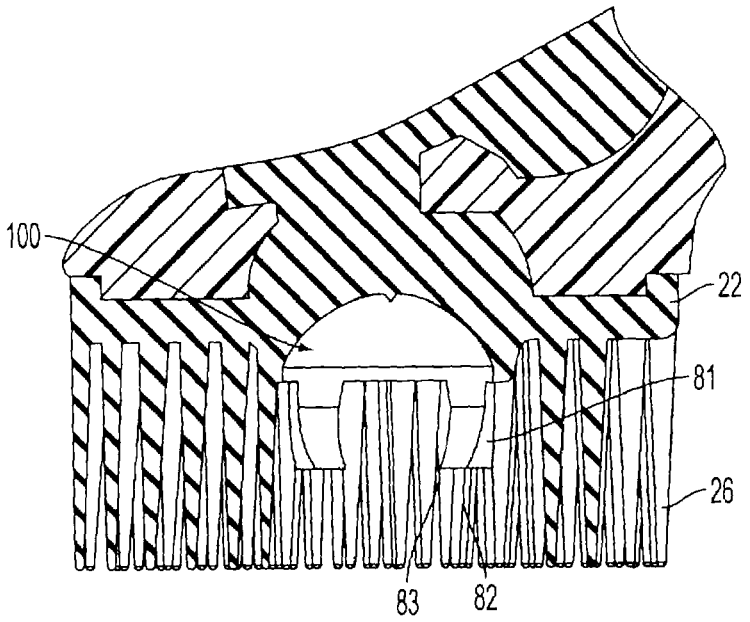
FIG. 10 is an enlarged cross-sectional side view of the head of FIG. 9 without showing the capsule.

With reference to FIGS. 8-11, in one construction, a basin, or cavity 100 is provided in carrier 80. As can be seen in FIGS. 9 and 10, basin 100 can be a concaved structure or hemispherical structure disposed in the interior area, beneath and between the retaining members 81. While a concaved structure is shown, other shapes for the basin 100 are possible, such as a triangular prism, a square prism or a rectangular prism. The basin 100 serves to retain a portion of the oral care material from the dispenser 32 to extend the beneficial cleaning effects of the oral care material during brushing. In this regard, the sweeping or oscillating motion of the carrier 80 transfers a portion of the retained liquid to inner region bristles 26*b* of the carrier 80.

In one construction, the retaining members 81 are columnar-like structures that extend upwardly from the carrier 80. The retaining members 81 can curve inwardly to further assist in holding the bead or capsule 32 in place. FIG. 10 illustrates a close-up cross-sectional view, showing such curved retaining members 81. Such curved retaining members 81 can have a length that extends more than halfway up (or down, depending on angle of view) the diameter of the bead or capsule 32 for retention. Hence, a length portion of the retaining members can be acutely disposed with respect to a vertical axis of the carrier 80 for retention. The combination of retaining members 81 provides a compressive force to hold the dispenser 32 in place. The inwardly disposed engaging surface 85 is generally smooth to reliably resist prematurely rupturing the dispenser 32 before use. (See FIG. 8) Also, the smooth and curved characteristic of engaging surface 85 provides for a generally uniform distribution of pressure on the surface of the dispenser 32. This construction thus reduces thin wall stress on the surface of the dispenser 32 to reliably resist prematurely rupturing the dispenser 32 before use. For example, shock forces acting on the toothbrush can be dissipated during transport operations.

The retaining members 81 can assist in rupturing the bead or capsule 32 during brushing, and can have a flat surface at a distal end 82 to form a corner edge 83 against the bead or capsule for this purpose. With reference to FIGS. 8 and 10, some of the bristles 26 can extend from the retaining members 81. In this construction, a portion of the base of the bristle extends from a rear/back of the retaining member 81. This provides a compact space-saving head structure and also provides flow control benefits of the oral care material in the bristle field.

As illustrated in HG. 10, the block 22 can be made of the same material as some or all of the bristles 26, as discussed above, which can be a different material from other portions of the handle. Alternatively, the handle and block can be made of the same material, with the bristles 26 being made of a different material.

Figure 11:
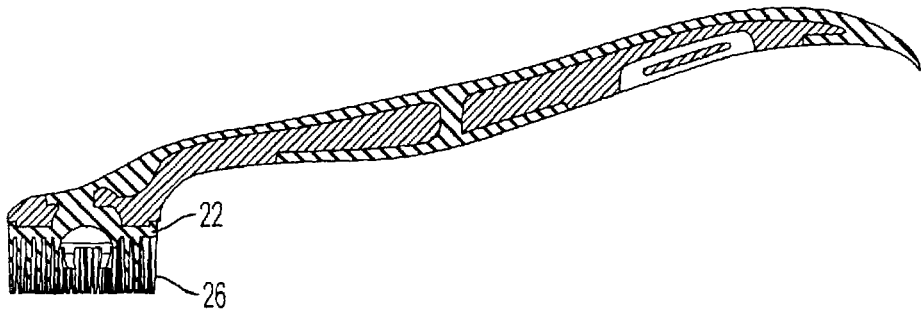
FIG. 11 is a cross-sectional side view of an alternate configuration toothbrush having the head shown in FIG. 10.
Figure 12:
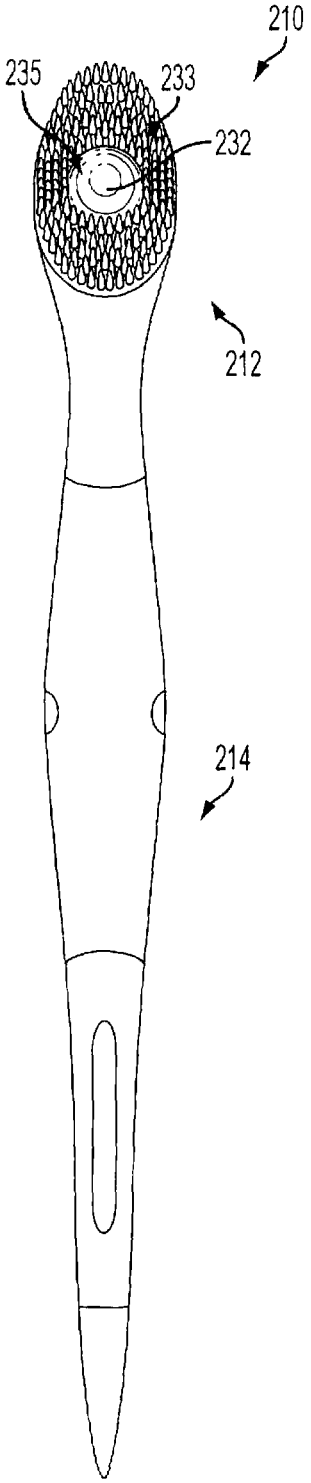
FIG. 12 is a front view of an oral care toothbrush having tooth cleaning elements, soft tissue cleaning elements, and a channel including a store of oral care material for providing oral care material to the tooth cleaning elements and the soft tissue cleaning elements.
Figure 13:
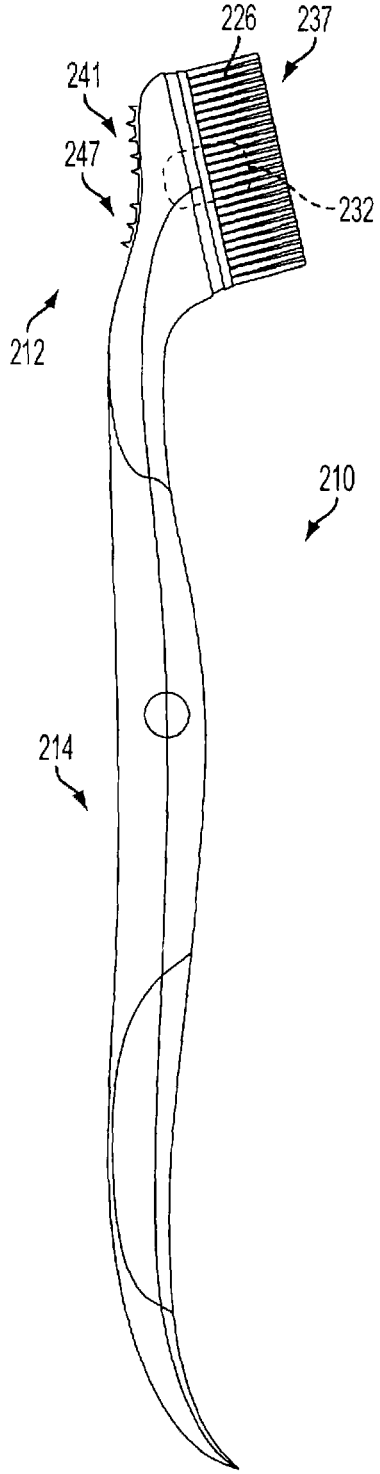
FIG. 13 is a side view of the toothbrush shown in FIG. 12.
Figure 14:
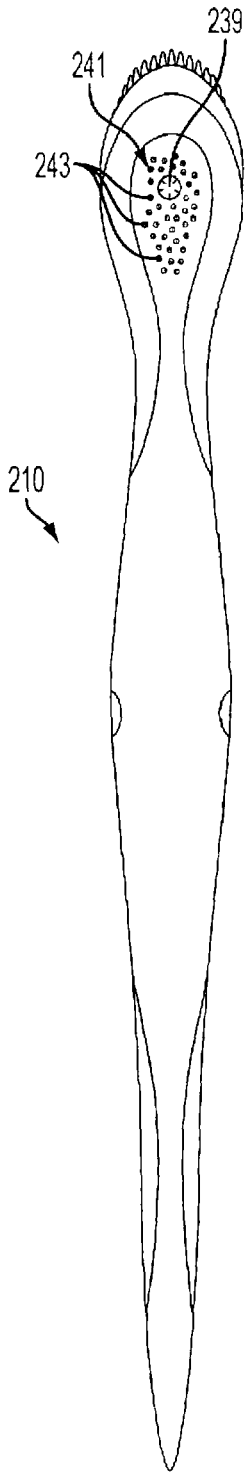
FIG. 14 is a rear view of the toothbrush shown in FIGS. 12-13.
Figure 15:
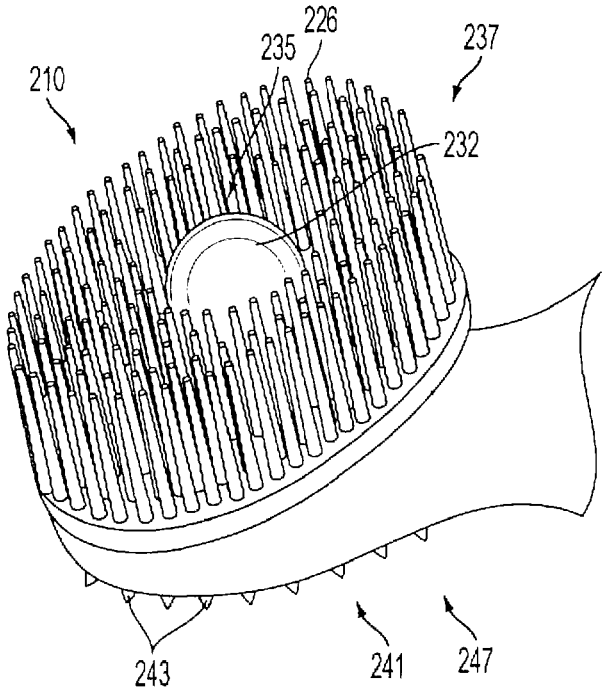
FIG. 15 is a perspective view of the head of the toothbrush of FIGS. 12-14.
Figure 16:
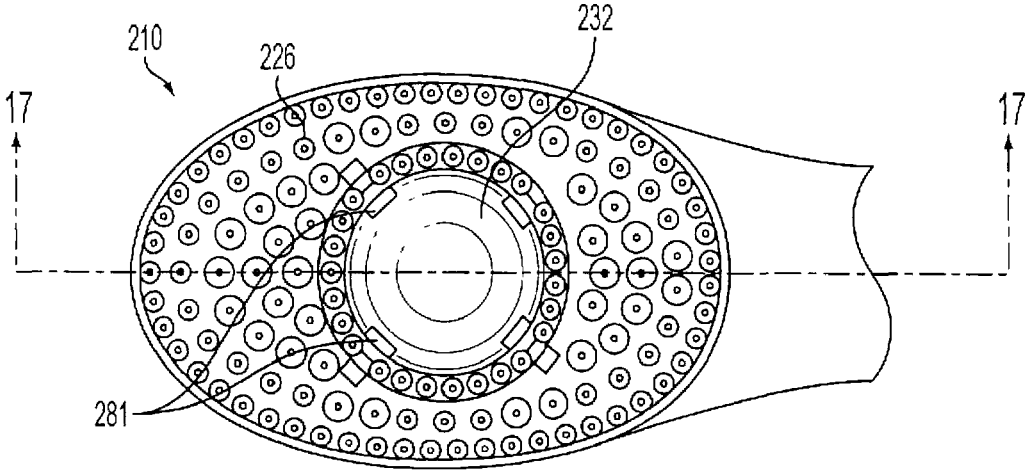
FIG. 16 is an enlarged front view of the head of FIGS. 12-14.

FIG. 11 illustrates a cross-sectional view of a toothbrush having the head or carrier structure 80 shown in FIGS. 8-10. The carrier 80 can be angled at a 10° angle with respect to the handle, representing a less-angled head than that shown in previous figures. An angle ranging from 8° to 12° can assist in improving a user's brushing technique. As with FIG. 10, FIG. 11 also shows an example arrangement of materials, where the block 22 can be made of the same materials as some or all of the bristles 26 and portions of the handle. Alternatively, the handle can be made of the same material as the block 22 and/or bristles 26.

Hence, in some configurations, an oral care implement can include a rupturable dispenser with an oral care material, as a connected unit or the various other combinations of components and materials as described. A toothbrush can have a toothpick which enables cleaning between the teeth. A dispenser containing a oral care material can be connected in the bristle or cleaning element portion of the toothbrush for dispensing the oral care material to the teeth to provide teeth cleaning and breath freshening or other oral care benefits to a user. In one construction, the oral care elements are configured to slow a radial flow of the oral care material released from the dispenser near an interior region of the carrier and increase a radial flow of the oral care material away from the interior region.

FIGS. 12-18 illustrate another configuration of an oral care implement in the form of a toothbrush 210 having a handle 214 and a head 212. Toothbrush 211 is similar to the toothbrush configuration of FIGS. 8-11, except as pertaining to a dispenser mechanism 233 and an optional soft tissue cleaner 241, such as a tongue cleaner. The dispenser mechanism 233 is a channel that includes a first and second dispensing path 235 and 239, through which oral care material like dentifrice can be dispensed to a plurality of faces on the toothbrush. As such, toothbrush 210 can provide enhanced dispensing and distribution of an oral care material during use by dispensing the oral care material to a plurality of faces. The oral care material can be dispensed quickly when dispensed simultaneously to the plurality of faces, can be distributed quickly and effectively by the plurality of cleaners (e.g., tooth and tongue cleaners) on the multiple faces, and can dispensed directly to the oral regions being cleaned. Further, toothbrush 210 can provide oral care material individually to a particular face that is being used, such as the face associated with tooth cleaning elements when the user is brushing teeth or to the face associated with a tongue cleaner when the user is cleaning the tongue.

The channel 233 of toothbrush 210 includes a passageway 231 with a dispenser 232, such as a store 232 of releasable oral care material that can be in the form of a head of packed oral care material, a capsule, or other releasable store configuration. A first path 235 and a second path 239 are in fluid communication with the passageway 231 and the store 232. Oral care material can be dispensed during use from store 232 to the tooth cleaning elements 226 on first face 237 through first path 235. Further, oral care material can be dispensed during use through second path 239 to a second face 247 and, if included thereon, to soft tissue cleaning elements 247. As with the configuration of FIGS. 8-11, the oral care material store 232 can be retained in the passageway 231 in the head 212 via retaining members 281 such as prongs or biasing members, at a position beneath the distal ends of bristles 226. Alternatively, the oral care material store may be press fit into the passageway 231 in the head 212.

During, use of toothbrush 210, oral care material can be dispensed simultaneously from the store 232 to both first face 237 and second face 247. It can be dispensed to first face 237 via first path 235. Which can include a gap in the field of bristles 226 and pathways through the bristles. First path 235 permits fluid communication between an upper portion of store 232 and first face 237. As such, oral care material can be dispensed through exposure of an upper surface area of a dissolvable store 232 to the user's saliva during use and/or through the release of oral care material from store 232, such as from a ruptured capsule.

Figure 18:
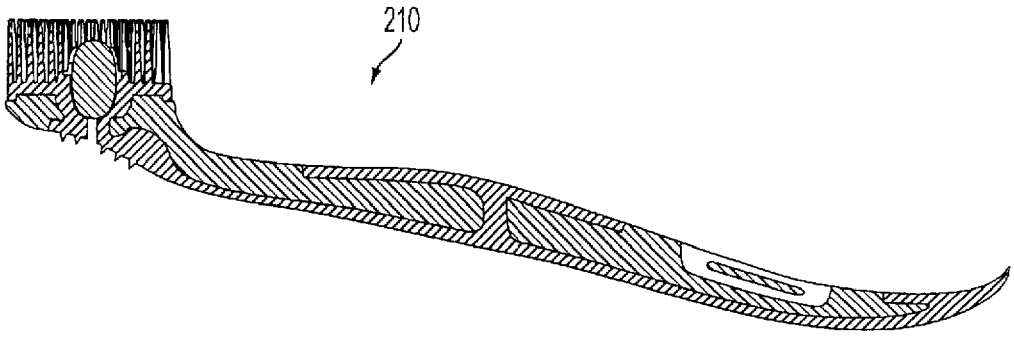
FIG. 18 is a cross-sectional side view of a toothbrush having the head shown in FIG. 17.
Figure 19:
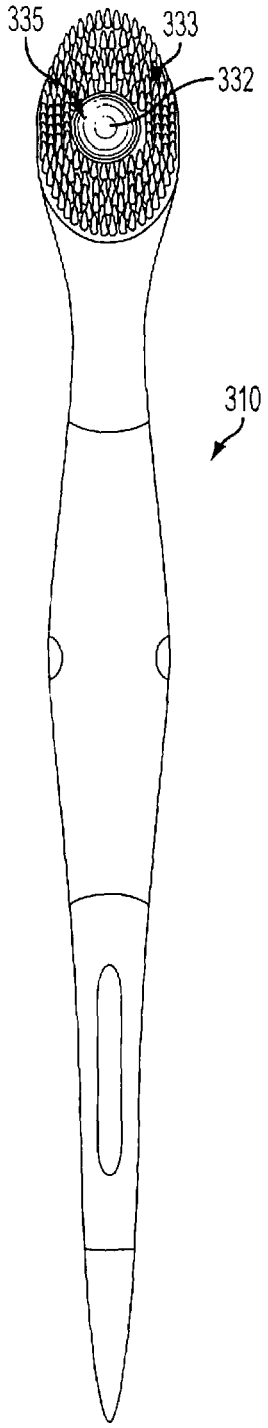
FIG. 19 is a front view of an oral care toothbrush having tooth cleaning elements, soft tissue cleaning elements, and a channel including a store of oral care material for providing oral care material to the tooth cleaning elements and the soft tissue cleaning elements.
Figure 20:
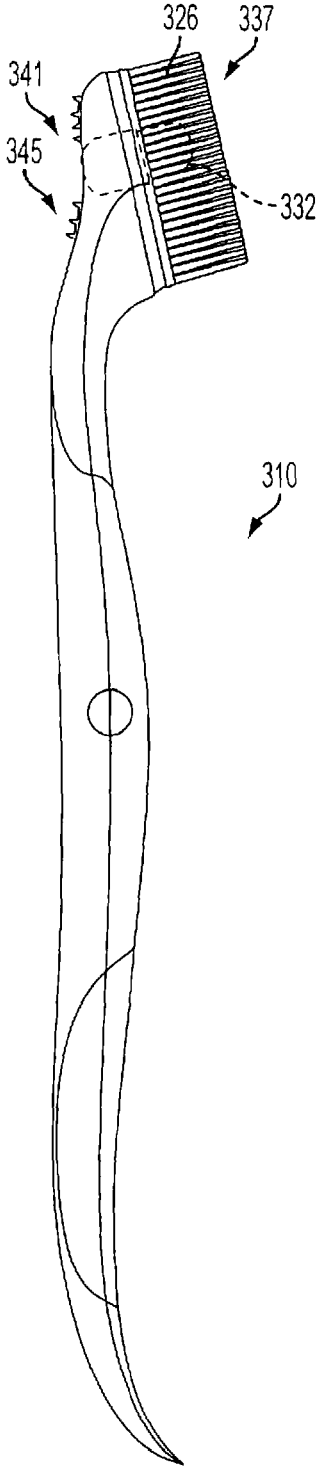
FIG. 20 is a side view of the toothbrush shown in FIG. 19.
Figure 21:
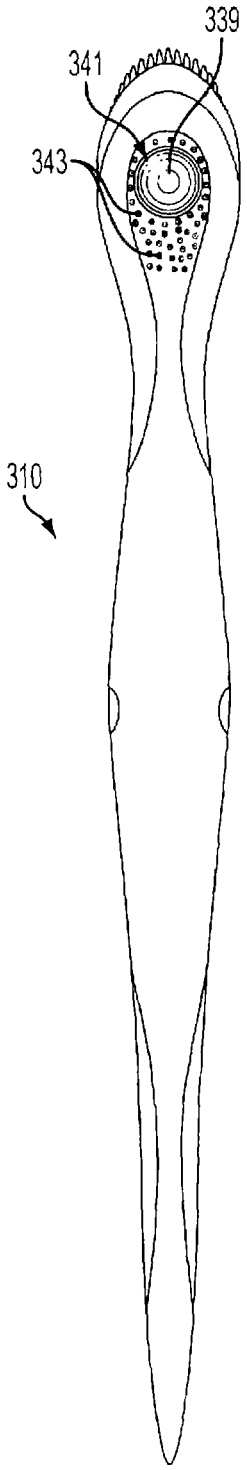
FIG. 21 is a rear view of the toothbrush shown in FIGS. 19-20.
Figure 22:
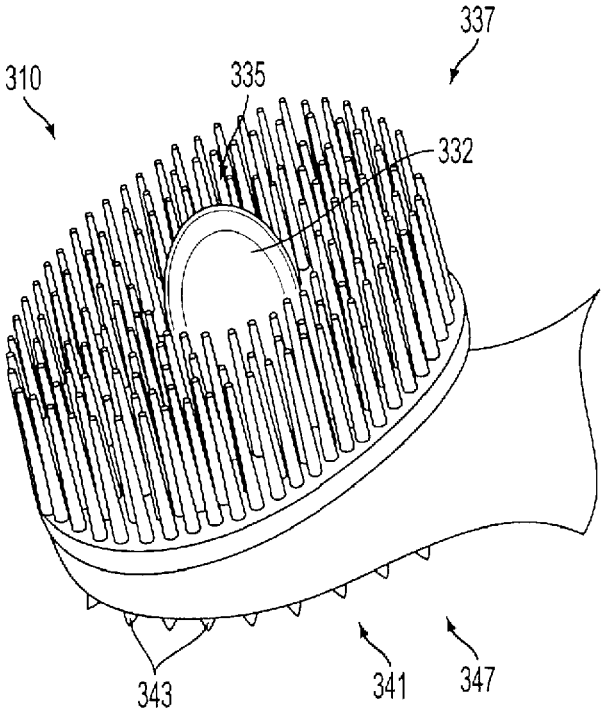
FIG. 22 is a perspective view of the toothbrush head of FIGS. 19-21.
Figure 23:
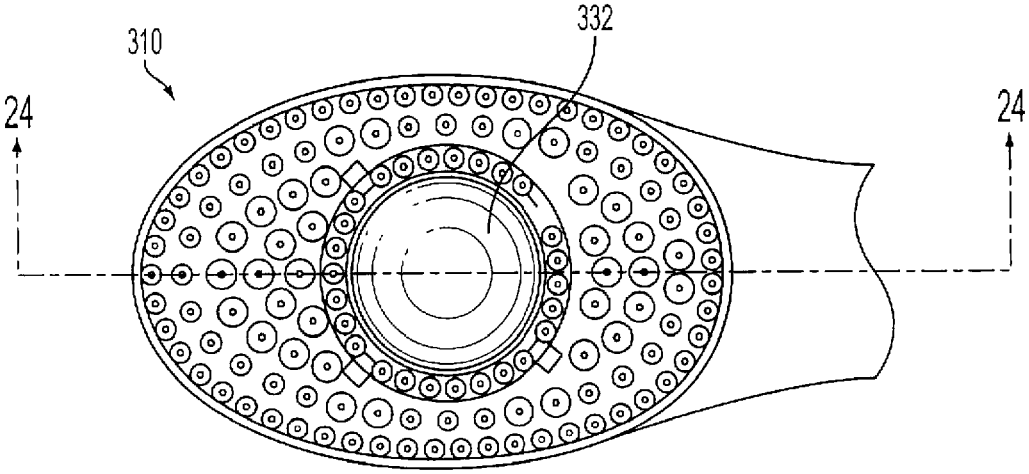
FIG. 23 is an enlarged front view of the head of FIGS. 19-21.

Oral care material can also be dispensed from store 232 to second face 247 via second path 239. This can also be accomplished through the exposure of a lower surface area of store 232 to the user's saliva during use via second path 239 and/or through released oral care material from store 232 travelling through second path 239 to second face 247. As shown in FIGS. 17 and 18, second path 239 provides fluid communication between second face 247 and store 232. In addition, a basin or cavity 200 can be provided below the dentifrice store to retain a lower portion of the store 232 and to guide released oral care material downward to second path 239 when the toothbrush is being used as a tongue cleaner.

Oral care material can be dispensed from second path 239 simultaneously with the release of oral care material through first path 235, such as when bristles 226 are engaging the user's teeth and soft tissue cleaner 241 is engaging the inside of the user's cheeks. During such use, saliva will flow in and out of paths 235 and 239 to enhance the distribution of oral care material to both the first and second faces 237, 247. However, oral care material can also be released individually from either the first or second path 235, 239 depending on the use of the toothbrush 210 or the configurations of the paths 235, 239. For instance, if toothbrush 210 were used solely to clean a user's tongue while the mouth was open, oral care material may be released only via second path 239 to second face 247. In another example, the comparatively small cross-sectional area of second path 239 shown in FIG. 17 can delay the release of oral care material there through in comparison with the cross-sectional area of first path 235. Thus, oral care material may be provided initially to first face 237 and later to both faces 237, 247.

The rate at which oral care material is dispensed to the faces 237, 247 can be the same or different. This can be due to factors such as the size and configurations of the paths 235, 239. In the example shown in FIG. 17, the flow rate of oral care material via first path 235 can be greater than the flow rate of oral care material via second path 239 due to the smaller cross-sectional area of second path 239. In another example, the oral care material dispense rates can be different for different types of oral care material, such as in the configuration of FIGS. 26 and 27 that includes as plurality of stores 432, 462.

The soft tissue cleaner 241 shown in FIGS. 13, 15, 17 and 18 includes soft tissue cleaning elements 243, which are configured to clean soft tissues in the mouth, such as the tongue and interior surfaces of the cheeks, lips or gums, by facilitating the removal of microflora and other debris and by distributing dentifrice—especially in the recesses of adjacent papillae of the tongue. Further, soft tissue elements 243 can improve the dissolution and dispersion of dentifrice in the oral cavity during use. Soft tissue cleaning elements 243 are shown in FIGS. 13, 15, 17 and 18 as protrusions, which can include nubs. However, it is understood that various types and configurations of soft tissue cleaning elements can be used, such as ridges, nubs, scrapers, bumps, sponges, fabrics, etc. in various combinations. As shown, soft tissue elements 243 can include protrusions made from TPE materials, which are rubbery and soft. In addition, soft tissue elements 243 can include protrusions made from LLDPE materials, which are still soft, but have superior flow characteristics that are well suited to filling very thin sections, and thus, can be more easily manufactured and can be manufactured to have thinner profiles.

Referring, now to FIGS. 19-25, another configuration of an oral care implement is shown in the form of a toothbrush 310. Toothbrush 310 generally includes the aspects and preferences of toothbrush 210 shown in FIGS. 12-18, except as discussed below with respect to its dispenser mechanism/channel 333. The channel 333 of toothbrush 310 includes a dispenser or store 332 of a releasable oral care material that extends though the head to provide efficient distribution of oral care material to both faces 337, 347 at a relatively high flow rate. Although shown in this example as a capsule 332, the store of oral care material can be in the form of a bead of packed oral care material such as dentifrice or other releasable storage configuration. The dispenser mechanism 333 further includes a first path 335 for dispensing the oral care material to first face 337 and tooth cleaning elements 326 thereon, as well as a second path 339 for dispensing oral care material to second face 347 and, if included thereon, to soft tissue cleaning elements 343.

Figure 24:
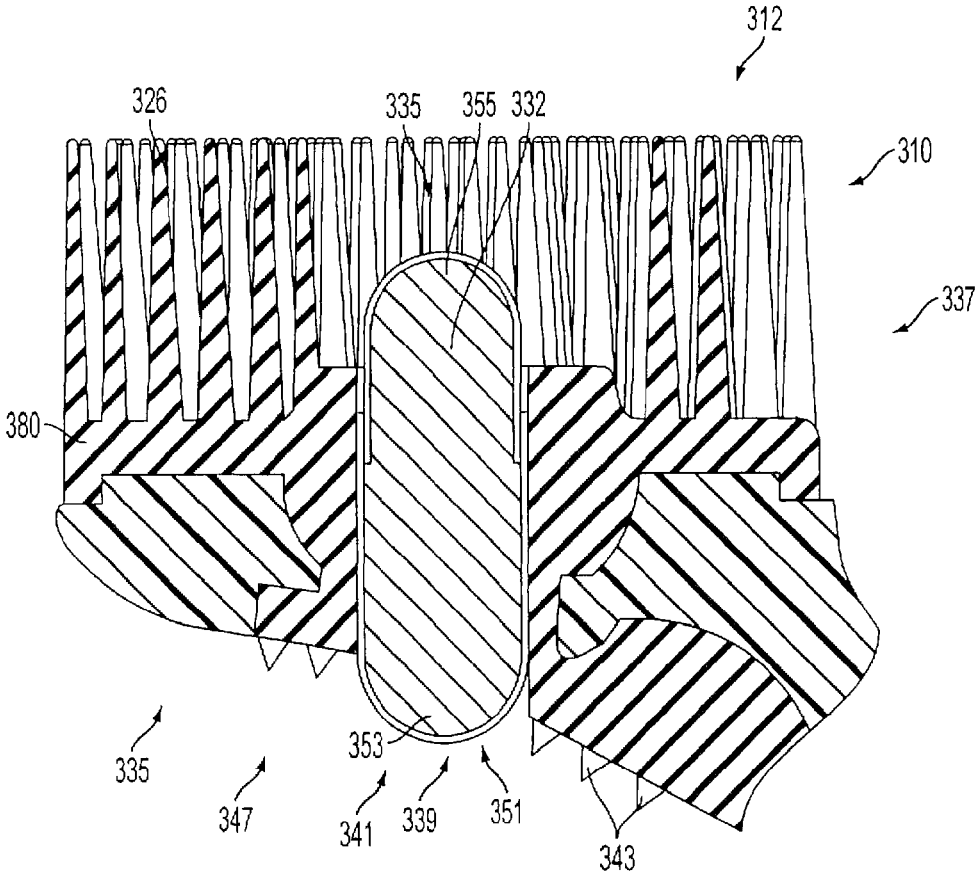
FIG. 24 is an enlarged cross-sectional side view of the bead of FIG. 23.
Figure 25:
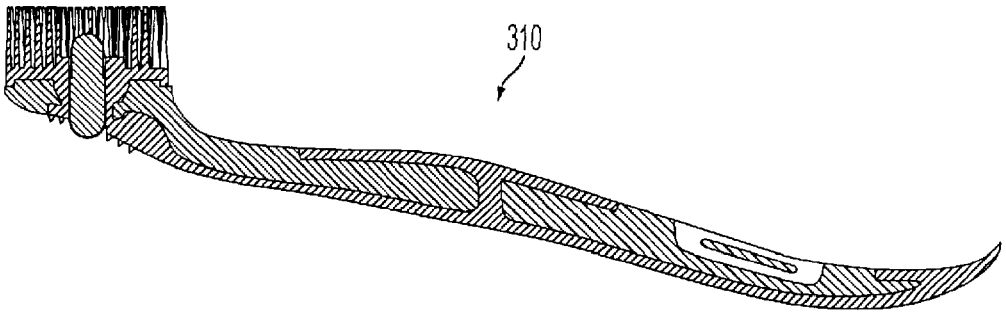
FIG. 25 is a cross-sectional side view of a toothbrush having the head shown in FIG. 24.

As shown in FIG. 24, a passageway 351 is formed through the central portion of head or carrier 380. Oral care material store 332 is shown in the exemplary form as a dissolvable and/or rupturable two-part capsule 332 having an upper portion 355 and a lower portion 353. The upper and lower portions 355, 353 overlap to form a shoulder of the capsule 332. Although the capsule 332 is a two-part capsule, it is considered a single store unit of oral care material. The capsule 332 may be retained within passageway 351 via a force fit or an adhesive connection. Alternatively, as with the configuration of FIGS. 8-11, the store 332 can be retained in the passageway 351 via retaining members such as prongs or biasing members. The retaining members could engage the shoulder of the capsule 332. Capsule 332 extends from first face 337 to second face 347 such that a lower portion 353 is exposed at second face 347 within son tissue cleaner 341 and preferably is raised above the plane of second face 347. Further, an upper portion 355 of capsule 332 preferably extends beyond passageway 351 to a raised position within the field of bristles 328. The raised position of the upper and lower portions facilitates contact between the capsule 332 and the user's teeth and/or soft tissues, which encourages rupturing and/or dissolving of the capsule 332 early in the oral care cleaning process.

As with toothbrush 210, oral care material can be dispensed from capsule 332 to both first face 337 and second face 347 either simultaneously or individually depending upon usage. It can be dispensed to first face 337 via fast path 335, which can include a gap in the field of bristles 26 and pathways through the bristles, and to second face 347 via second path 339, which can include a gap in the soft tissue cleaner 341. The oral care material can be dispensed at the same rate to both faces 337, 347 or at differing rates depending on the configuration. For instance, upper portion 355 of the capsule 332 can have a thinner or more readily dissolvable shell than the shell of lower portion 353.

Figure 26:
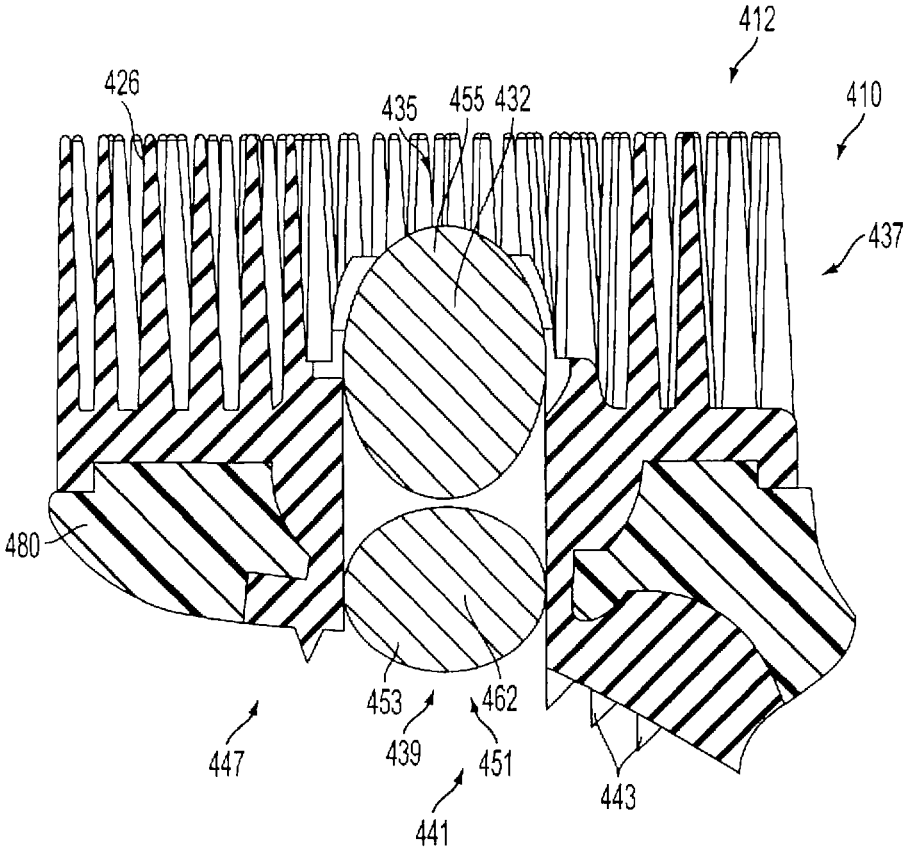
FIG. 26 is an enlarged cross-sectional side view of a head of an oral care toothbrush having tooth cleaning elements, soft tissue cleaning elements, and a channel including a plurality of oral care material stores for providing oral care material to the tooth cleaning elements and the soft tissue cleaning, elements.
Figure 27:
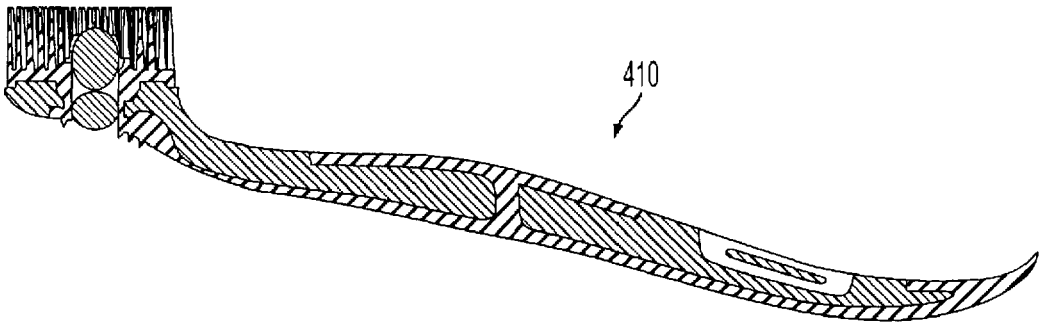
FIG. 27 is a cross-sectional side view of to toothbrush having the head shown in FIG. 26.

Referring now to FIGS. 26 and 27, another configuration of an oral care implement is shown in the form of a toothbrush 410. Toothbrush 410 generally includes the aspects and preferences of toothbrushes 210 and 310, except as discussed below with respect to its oral care material stores 432 and 462. The channel 433 of the toothbrush 410 comprises a first store unit or oral care material 432 and a second store unit of oral care material 462, which permit different oral care materials to be dispensed to the faces and/or the oral care materials retained in the first and second stores 432, 462 to be dispensed at different times via, for example, different dissolvability rates of the first and second stores 432, 462. Although shown in this example as a pair of store units 432 and 462, more than two store units 432, 462 can be included containing the same or different oral care materials and having the same or varying release rates. The stores 432 and 462 can be in the form of capsules, beads of packed oral care material such as dentifrice or other releasable story configurations in various combinations. The channel 433 further includes a first path 435 for dispensing oral care material from first store unit 432 primarily to first face 437 and tooth cleaning elements 426 thereon, as well as a second path 439 for dispensing oral care material from second store unit 462 to second face 347 and, if included thereon, to soft tissue cleaning elements 443.

As shown in FIG. 26, first store 432 can be retained in an upper portion of passageway 451 formed through a central portion of the head or carrier 480 in a manner similar to store 232 shown in FIG. 17. Second store 462 can be retained below the first store 432 within a lower portion of passageway 451 in a manner similar to store 332 shown in FIG. 24. Preferably, a lower portion of second store 462 is exposed at second face 447 within soft tissue cleaner 441 and preferably is raised above the plane of second face 447. Further, an upper portion 455 of first store 432 preferably extends beyond passageway 451 to a raised position within the field of bristles 428. The raised position of the upper and lower portions facilitates contact between the stores 432 and 462 and the user's teeth and/or soft tissues, which encourages rupturing and/or dissolving of the dentifrice stores early in the oral care cleaning process.

As with toothbrushes 210 and 310, oral care material can be dispensed from the stores 432, 462 to their respective faces 437, 447 either simultaneously or individually depending upon usage. Further, the oral care material from either store 432, 462 can be dispensed to both faces 437, 447 when the other store has been sufficiently depleted or if the configuration includes paths to both faces 437, 447.

Other configurations will be apparent to those skilled, in the art from consideration of the specification disclosed herein. It is intended that the specification and examples be considered as exemplary only, with the true scope and spirit of the invention being indicated by the following claims.

The invention claimed is:

1. An oral care implement comprising:

a handle;

a head coupled to the handle, the head having a first face, a second face opposite the first face, and a plurality of tooth cleaning elements extending from the first face;

a store of oral care material, the store of oral care material comprising first and second stores of oral care material retained at the head in a spaced apart manner from one another, wherein at least one of the first and second stores of oral care material comprises a gel dentifrice; and a plurality of retaining prongs extending from the first face and surrounded by the plurality of tooth cleaning elements, the plurality of retaining prongs retaining the store of oral care material such that at least a portion of the store of oral care material is disposed at a raised position above the first face and within an arrangement of the plurality of tooth cleaning elements.

2. The oral care implement of claim 1, further comprising a plurality of soft tissue cleaning elements extending from the second face.

3. The oral care implement of claim 2, wherein the plurality of tooth cleaning elements, the plurality of retaining prongs, and the plurality of soft tissue cleaning elements are formed from the same material.

4. The oral care implement of claim 2, further comprising a channel formed in the head and configured to dispense oral care material from the store of oral care material to the first face and the second face, wherein the channel is configured to dispense dentifrice from the store of oral care material simultaneously to the plurality of tooth cleaning elements and to the plurality of soft tissue cleaning elements.

5. The oral care implement of claim 4, wherein the channel comprises:

a first path formed in the head providing communication between the first face and the store of oral care material; and a second path formed in the head providing communication between the second face and the store of oral care material.

6. The oral care implement of claim 5, wherein the first path is configured to provide a first flow rate of oral care material released from the store of oral care material to the first face, and the second path is configured to provide a second flow rate of oral care material released from the store of oral care material to the second face.

7. The oral care implement of claim 6, wherein the first flow rate is greater than the second flow rate.

8. The oral care implement of claim 6, wherein the first flow rate is substantially the same as the second flow rate.

9. The oral care implement of claim 5, the first path is formed within an arrangement of the plurality of tooth cleaning elements and the second path is formed within an arrangement of the plurality of soft tissue cleaning elements.

10. The oral care implement of claim 5, wherein the channel further includes a passageway extending between the first and second faces and the store of oral care material is at least partially retained within the passageway.

11. The oral care implement of claim 10, wherein the store of oral care material extends between the first and second paths within the passageway.

12. The oral care implement of claim 11, wherein a first portion of the store of oral care material is exposed on the first face and a second portion of the store of oral care material is exposed on the second face.

13. The oral care implement of claim 1, wherein the store of oral care material comprises a bead of packed dentifrice.

14. The oral care implement of claim 1, wherein the store of oral care material comprises a capsule.

15. The oral care implement of claim 14, wherein the capsule is rupturable.

16. The oral care implement of claim 14, wherein the capsule is dissolvable.

17. The oral care implement of claim 1, further comprising an interproximal tooth cleaning element connected to an end of the handle opposite the head.

18. An oral care implement, comprising:

a handle;

a head coupled to the handle, the head having a first face, a second face opposite the first face, and a plurality of tooth cleaning elements extending from the first face;

a store of oral care material, wherein a first portion of the store of oral care material is exposed on the first face and a second portion of the store of oral care material is exposed on the second face; and a plurality of retaining prongs extending from the first face and surrounded by the plurality of tooth cleaning elements, the plurality of retaining prongs retaining the store of oral care material such that at least a portion of the store of oral care material is disposed at a raised position above the first face and within an arrangement of the plurality of tooth cleaning elements.

19. The oral care implement of claim 18, further comprising a channel formed in the head and configured to dispense oral care material from the store of oral care material to the first face and the second face.

20. The oral care implement of claim 19, wherein the channel further includes a passageway extending between the first and second faces and the store of oral care material is at least partially retained within the passageway.

* * * * *